United States Patent [19]

Early

[11] 4,429,641

[45] Feb. 7, 1984

[54] CERAMIC FURNACE DOOR AND FRAME

[75] Inventor: John D. Early, Hamburg, N.Y.

[73] Assignee: Bethlehem Steel Corporation, Bethlehem, Pa.

[21] Appl. No.: 335,964

[22] Filed: Dec. 30, 1981

[51] Int. Cl.[3] ..... F23M 5/00

[52] U.S. Cl. ..... 110/181; 110/173 R; 202/248; 432/250

[58] Field of Search ..... 110/173 R, 180, 181; 126/190; 122/498; 432/250, 252; 49/501; 264/30; 202/242, 248, 267 R

[56] References Cited

U.S. PATENT DOCUMENTS

| | | | |
|---|---|---|---|
| 1,407,708 | 8/1922 | Thornton | 432/237 |
| 3,980,028 | 7/1976 | Ginsburg | 110/173 R |
| 4,016,820 | 4/1977 | Johnson et al. | 110/173 R |
| 4,120,641 | 10/1978 | Myles | 432/250 |
| 4,174,331 | 11/1979 | Myles | 264/30 |
| 4,248,752 | 2/1981 | Myles | 264/30 |
| 4,300,882 | 11/1981 | Werych | 432/252 |

*Primary Examiner*—Edward G. Favors
*Assistant Examiner*—Steven E. Warner
*Attorney, Agent, or Firm*—John I. Iverson; William B. Noll; John J. Selko

[57] ABSTRACT

A cast ceramic hearth door and frame which provides a one-piece ceramic frame with provisions for a door to be slideably disposed within the one-piece frame.

2 Claims, 3 Drawing Figures

CERAMIC FURNACE DOOR AND FRAME

BACKGROUND OF THE INVENTION

Furnace hearth doors are currently constructed of cast iron shells rammed with a castable refractory. A cast iron mantle comprising many sections is bolted to the steel furnace outside frame and support beams to hold the door in place when closed. The furnace sidewall is constructed with a ramming or gunning refractory material such as Ram 80, manufactured by Plibrico Co. of Chicago, Illinois. The iron doors burn out and the castings warp and break up when the ramming material deteriorates and a loose fit results between the door and mantle. This condition allows heat to escape thereby escalating the deterioration of the furnace parts, and furthermore, increases fuel costs. The doors weigh in excess of 300 lbs. and in most cases must be opened by hand with a chain. It requires extensive mechanical and bricklayer repairs to keep the door working.

SUMMARY OF THE INVENTION

It is an object, therefore, of this invention to provide a door that will withstand the hostile environment of the furnace.

It is another object of this invention to provide a one-piece ceramic furnace door frame.

It is still a further object of this invention to provide a one-piece ceramic door frame with means for slideably disposing a cast ceramic door in the door frame.

The present invention accomplishes these objects by providing a furnace hearth door frame cast in one piece from a castable refractory and provided with a recessed portion to receive a cast ceramic door slideably disposed within the recessed portion of the furnace hearth door frame.

DESCRIPTION OF THE PREFERRED EMBODIMENT

Figure 2:
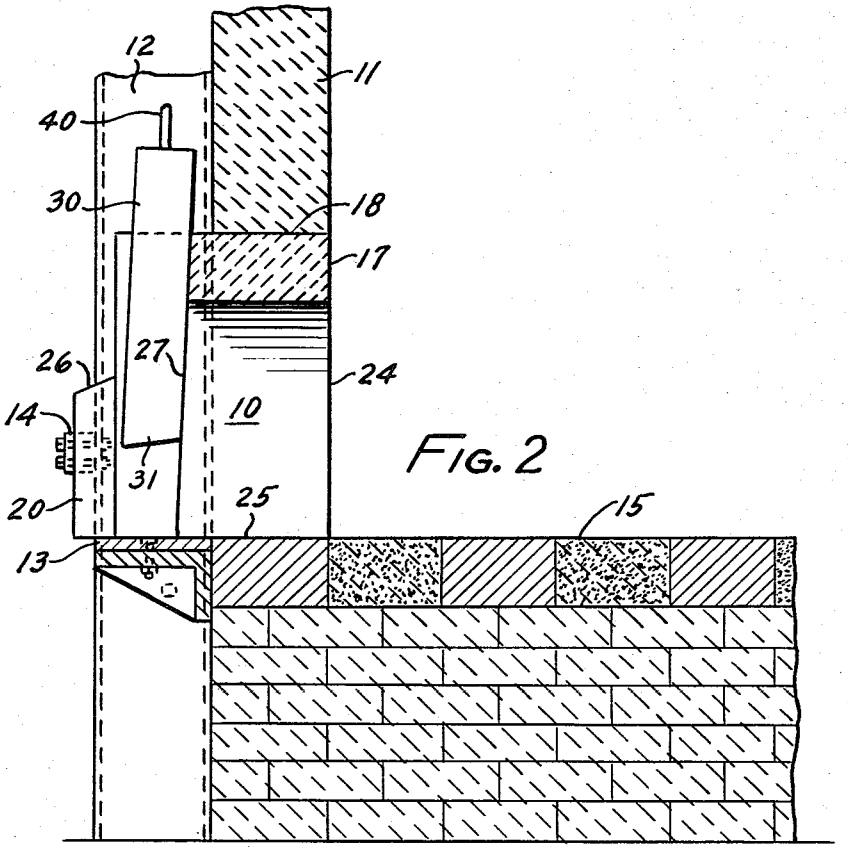
FIG. 2 is a sectional view through the furnace hearth door taken on line 2—2 of FIG. 1.
Figure 1:
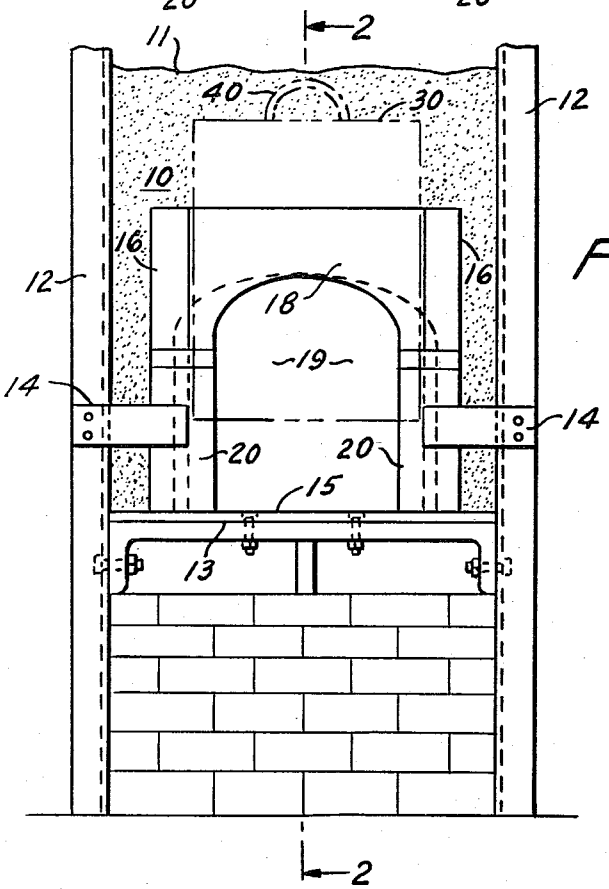
FIG. 1 is a front view of a furnace hearth door frame installation according to the instant invention.
Figure 3:
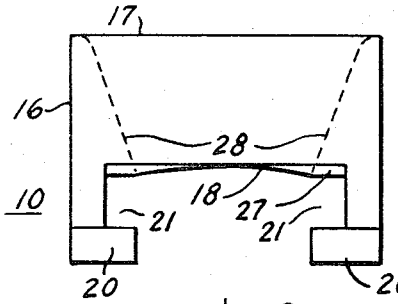
FIG. 3 is a detailed top view of the hearth door frame of the invention.

Referring now to the drawings and particularly to FIGS. 1–3 inclusive the hearth door frame 10 of the instant invention is seen located in furnace sidewall 11 between sidewall support buckstays 12 and supported on cast sill plate 13. The one-piece door frame 10 is designed to be placed in the sidewall 11 of a furnace, e.g. reheat furnace, and sealed by means of ramming material in the clearance between the buckstays 12 and outer edges of the door frame 10. Steel plates 14 fixed on the buckstays 12 extend from the buckstays 12 toward the door frame 10 to hold the frame 10 in position until the sidewall is rammed around the frame. Thereafter the plates 14 are left in place for extra support.

Cast steel sill plate 13 extends between and is supported on adjacent buckstays 12 in front of the hearth door opening and at the hearth level 15.

The one-piece ceramic furnace hearth door frame 10 comprises sides 16, back 17, mantle 18, opening 19, front walls 20 and recessed portion 21. The front portion of the hearth door frame 10 is supported on cast sill plate 13 and the rear portion 24 of the hearth door frame 10 is supported in the furnace sidewall 11 on the hearth portion 25 which extends through the sidewall 11.

The front walls 20 extend upwardly from the cast steel sill plate 13 for a distance convenient for installing a ceramic door 30. The tops 26 of front walls 20 are sloped to facilitate installation and removal of the door 30. The backwall 27 of recessed portion 21 of frame 10 is tapered slightly to permit door 30 to lay back against the backwall 27 for sealing engagement between the door and recessed portion of the frame. The bottom 31 of door 30 is also tapered to force the back of door 30 against the back of recessed portion 21.

The furnace opening 19 below the mantle portion 18 diverges on lines 28 to provide a flared opening on the furnace side to prevent sharp corners on the inside of the furnace and give a better line of sight into the furnace.

SPECIFIC EXAMPLE

The hot strip mill slab reheat furnaces of a steel plant use a cast ceramic frame and door on the hearth sidewalls. The cast ceramic hearth door frame is cast in one piece for quick and positive installation in the hearth sidewalls replacing the cast iron frames and steel furnace parts previously required. The door frame is provided with a recessed portion to slideably dispose a cast ceramic door therein to close the furnace hearth opening.

The hearth doors and frames are used when normal hearth cleaning during rolling is required. Door openings are also required for visual inspection inside the furnace and to allow materials to be sent in and out of this area of a furnace when it is down for internal repairs.

The one-piece furnace hearth door frame 10 measures 37″ wide, 27″ high and 19½″ total depth. Front walls 20 extend upward from the sill plate 13 approximately 16″ with a taper of the top 26 of about 1″ in 4″ downward away from the furnace. The door opening 19 in the frame 10 measures 23″ wide with a height to the top of the arched opening of about 21″. The height of the mantle above the opening is 6″. Recess 21 is formed by frontwalls 20, sidewalls 16 and backwall 27. The door opening 19 formed by diverging walls 28 flares inwardly to widen the opening on the furnace side to prevent sharp corners on the inside of the furnace where slabs moving through the furnace might hang up. The door 30 which is also cast in one piece from the same material as the door frame 10 measures 29″ wide by 26″ high and is 5″ thick and is slideably disposed in the recess 21 cast in the furnace door frame.

The hearth door frame 10 is cast in one piece using an Alumina-Silica-Base castable refractory, i.e. ASTM C401-77 Class E with low iron content featuring increased hot strength, abrasion resistance and less hot load deformation of conventional castables in its class. The castable material used is Plicast® HyMor 3000, a product of the Plibrico Company, Chicago, Illinois.

The door 30 is also cast of the same material and contains a stainless steel rod 40 designed to provide a lifting means at the upper end of the door.

I claim:

1. In a furnace having a hearth door and frame, the improvement comprising a one-piece cast ceramic door frame, said door frame including:

(a) two sides, each of said sides having:

(i) a front portion supported on a sill plate and a rear portion supported on a furnace sidewall;

(ii) a front wall extending upwardly from said sill plate;

(iii) a tapered back wall; and (iv) a recessed portion between said front wall and said back wall for slidably receiving a furnace door;

(b) a hearth extending between said two sides; and (c) a door opening formed by said two sides and said hearth, said door opening flaring inwardly to widen on said furnace side.

2. The improvement of claim 1 further comprising a cast ceramic door disposed in said recess.

* * * * *